US005114062A

United States Patent [19]

Kuhn et al.

[11] Patent Number: 5,114,062

[45] Date of Patent: May 19, 1992

[54] ROLL FOR GUIDING WEB TYPE MATERIAL

[75] Inventors: Friedrich Kuhn, Heidenheim; Wolfgang Drefs, Huttlingen; Hans Ruff, Heidenheim; Siegbert Scheuter, Herbrechtingen, all of Fed. Rep. of Germany

[73] Assignee: J.M. Voith GmbH, Heidenheim, Fed. Rep. of Germany

[21] Appl. No.: 453,619

[22] Filed: Dec. 19, 1989

[30] Foreign Application Priority Data

Dec. 22, 1988 [DE] Fed. Rep. of Germany ..... 3843246

[51] Int. Cl.[5] ..... B65H 20/12

[52] U.S. Cl. ..... 226/95

[58] Field of Search ..... 226/7, 95, 93, 97

[56] References Cited

U.S. PATENT DOCUMENTS

| | | | |
|---|---|---|---|
| 3,593,901 | 7/1971 | Eltz et al. | 226/95 |
| 3,869,095 | 3/1975 | Diltz | 242/56 R |
| 4,207,998 | 6/1980 | Schmid | 226/95 |
| 4,408,727 | 10/1983 | Dropczynski | 242/56 R |
| B14,249,688 | 8/1984 | Klemm | 226/24 |

FOREIGN PATENT DOCUMENTS

| | | | |
|---|---|---|---|
| 0118384 | 9/1984 | European Pat. Off. . | |
| 1474973 | 4/1971 | Fed. Rep. of Germany . | |
| 0043757 | 3/1984 | Japan | 226/95 |
| 496626 | 12/1938 | United Kingdom | 226/95 |
| 747285 | 3/1956 | United Kingdom | 226/95 |
| 968555 | 9/1964 | United Kingdom | 226/95 |

*Primary Examiner*—Daniel P. Stodola
*Assistant Examiner*—P. Bowen
*Attorney, Agent, or Firm*—Baker & Daniels

[57] ABSTRACT

A roll for guidance of web type material, such as paper or cardboard, has a shell that features a multitude of bores. The roll is coordinated with a device for subjecting the roll interior to suction. To hold the web on the roll at standstill, part of these bores can be subjected to suction. In the opeation of the roll, air trapped between the web and the roll shell can enter the roll also through the remaining bores and escape in the roll area that is not looped by the web.

8 Claims, 1 Drawing Sheet

ROLL FOR GUIDING WEB TYPE MATERIAL

BACKGROUND OF THE INVENTION

The present invention concerns a roll for guiding web type material, specifically paper or cardboard which loops around the roll across part of its circumference, with a shell featuring a multitude of bores. A portion of the bores is covered by a covering device contained in the interior of the roll, while another portion can be subjected to suction from the interior of the roll.

Prior art rolls are known, for example, from German Patent Publication 14 74 973, German Patent Publication 28 12 099, German Patent Document 27 20 871, European Patent Document 01 18 384 and U.S. Pat. No. 3,869,095, respectively. On such rolls, only part of the roll shell is covered by the web. In the absence of specific design provisions, air is of necessity sucked through the bores in the uncovered area of the roll shell. This arrangement is undesirable and results in a loss of power. On the rolls according to the four references cited above, such design provisions have been made, for instance, in the form of suction segments in order to limit the intake space to the sector of the roll that is looped by the web. However, such design provisions require considerable construction expense.

Attempts have been made toward keeping the number and the cross-section of the bores as small as possible, so that the retention of the web on the roll is assured. An example may be found in German Patent Document No. 29 20 707. However, this is only a compromise and not an optimum solution.

This roll serves the function of a support roll in a dual support roll winder. In such a machine, during exchange of the reel for a new core, the roll is at standstill and subjected to suction in order to hold a new web leader looped on the roll shell until the core has been placed in the winder bed. The web leader previously has been formed by a severing operation. Since only part of the roll shell is covered by the web, leakage air passes of necessity through the uncovered bores during the suction operation. In the prior known roll, therefore, the number and cross section of the bores are kept at a minimum in order to avoid over-dimensioning the suction device that ensures the adherence of the web to the roll. The device for evacuating the interior of the roll is turned off during the winding operation.

During the winding operation, air is entrained by the moving web and also by the roll shell. The air trapped in the gore between the roll shell and the web can partly enter the roll through the bores contained in the roll shell and can escape through the bores of the shell area that is not covered by the web. But the number of bores in the roll shell and their size is not sufficient for that purpose, especially when operating at high winding speeds and with air-impermeable webs, for instance of coated paper. Therefore, air bubbles occur between the roll shell and the web or the web floats on the roll because its contact with the roll shell has been extensively eliminated. To remedy this shortcoming, which affects the quality of winding, it is also known to provide the roll shell with a helical grooving on its outer circumference, but this measure has only a limited effect.

Therefore, the problem underlying the invention is to improve a roll of the aforementioned type to the effect that the entire air volume trapped between the web and the roll shell is removed and the adherence of the web to the roll is achieved with little expense.

SUMMARY OF THE INVENTION

This problem is solved by the present invention by providing that only part of the multitude of bores in the roll shell are subjected to suction. This part of the bores must be so dimensioned that the newly formed web leader will be held on the roll circumference while the reel is changed. The additionally provided bores are not connected with the device for evacuating the interior of the roll and, therefore, are ineffective during the change. Therefore, the device for evacuating the interior of the roll only needs an economically dimensioned capacity which fulfills this function. The air trapped in the winding operation in the gore between the web and the roll shell can penetrate into the roll through the remaining bores, however, and escape in the area of the roll shell not covered by the web.

With the solution of the present invention, therefore, it is possible in a simple way to meet two contradictory requirements: (1) subjecting only as much bore cross section area to suction as is necessary to ensure that the web leader will be safely held on the roll; and (2) making sufficient bore cross section area available to avoid air being trapped between the web and the roll.

Further favorable advancements of the invention include the following: By separating the bores in zones, the connection to the suction device of those bores that can be subjected to suction is achieved at low cost. A separation between those bores that can be subjected to suction and those that cannot is accomplished in a simple way through components fixed in the roll. The channel system can be suitably reduced to practice by noncutting forming of semifinished materials, where the adherence to the interior circumference of the roll is achieved through elastic contact pressure of the channel components. Providing the bores of different zones with the same diameters helps achieve a manufacturing advantage.

BRIEF DESCRIPTION OF THE DRAWING

Embodiments of the invention will be more fully explained hereafter with the aid of the drawing.

DESCRIPTION OF THE PREFERRED EMBODIMENTS

Figure 1:
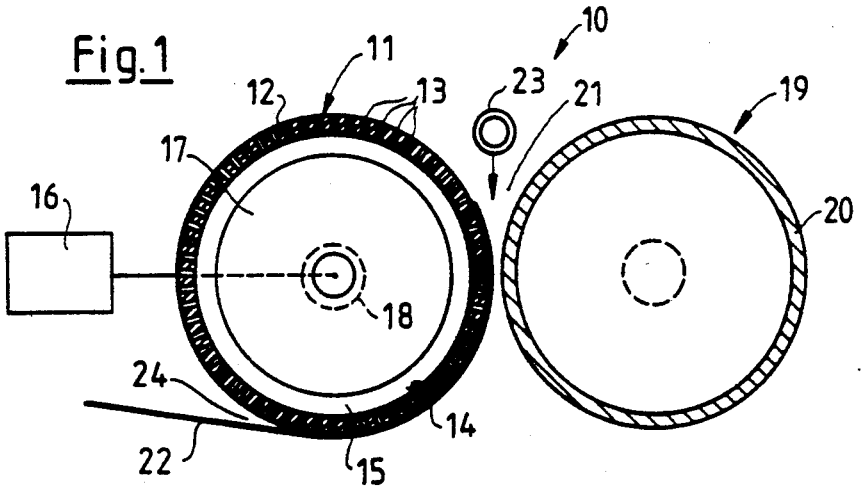
FIG. 1 shows a cross section of a winding machine with a roll looped by a web and capable of being subjected to suction, in a schematic presentation.

A dual support roll winder marked 10 has a roll 11 with a shell 12 that features a multitude of through bores 13 (FIG. 1). On its inner circumference 14, the roll 11 is provided with a channel system 15, which will be explained in greater detail below in conjunction with FIGS. 1 and 2. Part of the bores 13 empty into channel system 15. Additionally, the roll 11 is coordinated with a device 16 for evacuating the roll interior 17 through a hollow journal 18. Another part of the bores 13 empty into the roll interior 17. Mounted beside the roll 11, axially parallel thereto, is a second roll 19 with a continuous shell 20. Both rolls 11 and 19 form in their upper gore a winding bed 21. Moreover, both rolls 11 and 19 are provided with a not illustrated drive. A web 22 (paper or cardboard) looping around the roll 11 runs from below into the winding bed 21 where it is wound on a core 23.

When exchanging a finished reel for a new core 23, the reel (not illustrated) is first severed from the approaching web 22 at machine standstill (or at very low winding speed). During the severing process, the suction device 16 is activated, thereby creating a vacuum in the interior 17 of the roll 11. This vacuum acts on the web 22 through the part of the bores 13 that are not connected to the channel system 15, thereby retaining the new web leader on the roll shell 11. The suction device 16 is turned off after insertion of the new core 23 in the winding bed 21 at the start of a new winding process. In winding the new reel, the approaching web 22 and the roll shell 12 carry air into the entrance gore 24 formed by the web and the shell. The air which backs up in the gore 24 passes through the suction type bores 13 into the interior 17 of the roll and through those bores coordinated with the channel system 15, and escapes to atmosphere. The air flows through the interior 17 of the roll and through the channel system 15 and escapes through the bores 13 that are not covered by the web 22. The coordination of a part of the bores 13 with the channel system 15 and of another part of the bores with the suction device 16 will be described hereafter with the aid of two embodiments.

Figure 2:
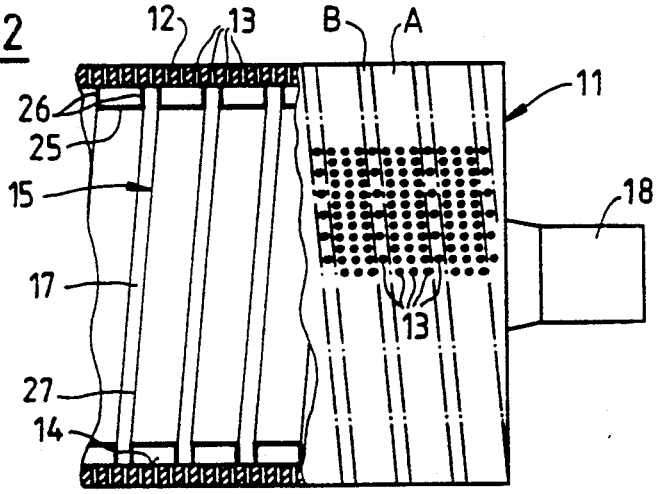
FIG. 2 shows a view of a partially cut away section of the roll looped by the web, as a first embodiment, at a scale larger than in FIG. 1.

Referring to the embodiment illustrated in FIG. 2, it can be seen that the channel system 15 consists of a helical U-profile channel 25 whose sidewalls 26 bear with their free end face on the inner circumference 14 of the roll 11. Coordinated with the channel system 15 formed by the profile helix 27 (which on its ends is sealed) is a zone A that extends helically along the roll shell 12. The major part of the bores 13 in the roll shell 12 are located in the zone A, their dense arrangement being illustrated in the drawing only on a portion of the roll 11. The remaining part of the bores 13 are located in a zone B of the roll shell 12 in an area which on the inner circumference 14 is not covered by the channel system 15. The arrangement of these latter bores 13 in the helical, narrow zone B is also illustrated in the drawing only on a portion of the roll 11. However, the bores 13 are in fact arranged on the entire web-swept circumference of the roll 11. The bores in both zones A and B are equal in diameter for manufacturing reasons.

The shell 12 of the roll 11 thus has two zones A and B with an open cross-sectional area of bores varying per unit of area. Zone B has only a limited open cross-sectional area of bores with relatively few bores 13 which (as mentioned) empty directly in the interior 17 of the roll 11. In evacuating the roll interior 17, the vacuum is effective only on these few bores 13, since the bores of the zone A are separated from the interior by the channel system 15. The limited open cross-sectional area of bores of zone B is sufficient to hold the new leader of the web 22 on the shell 12 of the roll 11 while a finished reel (not illustrated) is exchanged for a new core 23. As compared to zone B, zone A has a very much larger number of bores 13 and, consequently, also a considerably larger open cross-sectional area of bores. The ratio of cross-sectional area of bores A and B may assume a value, e.g., of 30:1.

As already described above, the air in the entrance gore 24 can during the winding operation enter through both the bores of the zone A into the channel system 15 and the bores of the zone B into the interior 17 of the roll, and escape in the exposed area of the roll 11 through the not covered bores of the channel system and the roll interior. The effectiveness of a large open cross-sectional area of bores for dissipating the air from the entrance gore 24 makes it possible to safely prevent the formation of air bubbles or a floating of the web 22 on the roll 11, even at very high winding speeds and with webs impermeable to air.

Figure 3:
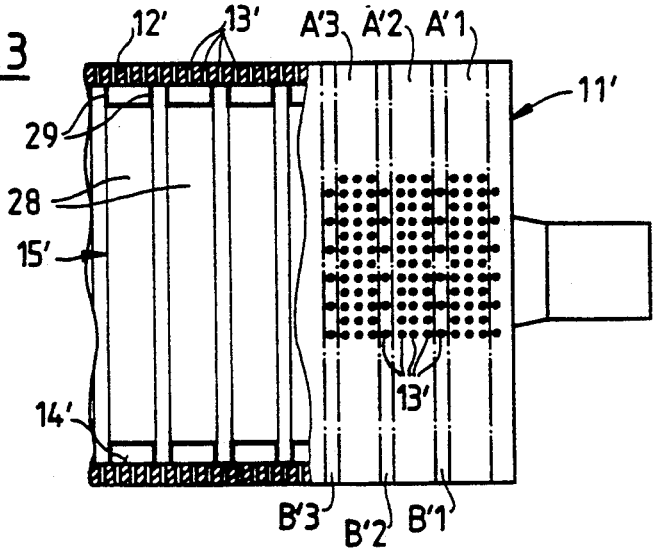
FIG. 3 shows, in a corresponding illustration, an embodiment varying from FIG. 2.

In the second embodiment of the evacuable roll 11' illustrated in FIG. 3, the bores 13' are coordinated with zones A' and B' as well in varying numbers. The zones alternate as cylinder sections of the roll shell 12'. In particular, a zone A'1 is followed by the zone B'1, then a zone A'2 by a zone B'2, etc. The zones A' and B' are separated here as well by a channel system 15' which is arranged on the inner circumference 14' of the roll 11' and into which empty the bores 13' of the zones A'1, A'2, etc. The channel system 15' consists of rings 28 having a U-shaped cross section, the sidewalls 29 of which bear with their free end faces on the inner circumference 14' of the roll 11'. As indicated also in FIG. 3, the major part of the bores 13' are coordinated with the zones A'1, A'2, etc., so that a relatively large open cross-sectional area of bores communicates with the ring 28 of the channel system 15'. In contrast, the zones B'1, B'2, etc., feature only a limited share of bores 13' and, therefore, have a limited open cross-sectional area of bores that can be subjected to suction. The mode of operation of the roll 11' is the same as in the embodiment relative to FIG. 2.

In variation from the two embodiments described above, the channel system can be coordinated also with the zone having a limited open cross-sectional area of bores. The channel system is then connected with a device for generating a vacuum.

What is claimed is:

1. A roll for guiding web type material, comprising:

a roll shell having a multitude of through bores, in which said roll shell has an inner circumference, said bores being disposed in at least two zones, the bores in one of said zones being covered by a covering device contained interiorly of said roll, said covering device comprising channel means defining a ring having a generally U-shaped profile and having sidewalls whose end faces bear on the inner circumference of the roll shell, said channel means being open toward said roll shell, the bores in the other of said zones being subject to suction interiorly of said roll.

2. The roll according to claim 1, wherein said ring extends helically along said inner circumference.

3. The roll according to claim 1, in which said roll shell includes a plurality of zones having bores covered by said covering device and a plurality of zones having bores subjected to said suction, said zones having said covered bores being positioned in axially alternating relationship along said roll shell with said zones having said bores subjected to suction, wherein said channel means defines a plurality of annular rings disposed along said inner circumference, said annular rings being positioned so that each of said annular rings covers a separate one of said zones having said covered bores.

4. A roll for guiding web type material, comprising:

a roll shell having a multitude of through bores, said bores being disposed in at least two zones, vacuum means adapted to exert a suction force which originates from the axial center of said roll, cover means disposed interiorly of said roll for protecting the bores in one of said zones from said vacuum, the bores in the other of said zones being subjected to said vacuum, said cover means comprising a channel defining at least one ring which extends circumferentially around the entire inner surface of said roll shell, said channel being open toward said roll shell.

5. The roll according to claim 4, wherein said at least one circumferentially extending ring comprises a helical ring having a generally U-shaped profile, said ring having sidewalls whose end faces bear on the inner circumference of the roll shell.

6. The roll according to claim 4, wherein said at least one ring is generally annular, said annular ring having sidewalls whose end faces bear on the inner circumference of the roll shell.

7. The roll according to claim 4, in which said roll shell includes a plurality of zones having bores protected from said suction force and a plurality of zones having bores subjected to said suction force, said zones being oriented in axially alternating relationship along said roll shell, said at least one circumferentially extending ring comprising a plurality of annular rings, each of said rings covering a separate one of said zones having protected bores.

8. The roll according to claim 1, in which the bores of both zones have the same diameter.

* * * * *